US010376904B2

(12) United States Patent
Jack

(10) Patent No.: US 10,376,904 B2
(45) Date of Patent: Aug. 13, 2019

(54) HEAD AND SHOULDER SHOWERHEAD SYSTEM

(71) Applicant: Diane Jack, Lake Mary, FL (US)

(72) Inventor: Diane Jack, Lake Mary, FL (US)

( * ) Notice: Subject to any disclaimer, the term of this patent is extended or adjusted under 35 U.S.C. 154(b) by 0 days.

(21) Appl. No.: 15/657,785

(22) Filed: Jul. 24, 2017

(65) Prior Publication Data

US 2019/0022671 A1 Jan. 24, 2019

(51) Int. Cl.

| | |
|---|---|
| ***B05B 1/00*** | (2006.01) |
| ***B05B 1/18*** | (2006.01) |
| ***E03C 1/04*** | (2006.01) |
| *B05B 1/16* | (2006.01) |
| *E03C 1/02* | (2006.01) |
| *B05B 17/08* | (2006.01) |

(52) U.S. Cl.

CPC ..... *B05B 1/185* (2013.01); *B05B 1/18* (2013.01); *E03C 1/0408* (2013.01); *B05B 1/16* (2013.01); *B05B 17/085* (2013.01); *E03C 2001/026* (2013.01)

(58) Field of Classification Search

CPC . E03C 1/04; E03C 1/0404; E03C 1/06; E03C 1/0408; E03C 1/066; E03C 2201/30; B05B 1/18; B05B 1/185

USPC ..... 4/601, 567, 570; 239/443, 588, 197

See application file for complete search history.

(56) References Cited

U.S. PATENT DOCUMENTS

| | | | | | |
|---|---|---|---|---|---|
| 1,758,115 | A * | 5/1930 | Kelly | A47K 3/28 | 239/282 |
| 2,685,093 | A * | 8/1954 | Lundquist | E03C 1/06 | 4/615 |
| 3,471,872 | A * | 10/1969 | Symmons | E03C 1/0408 | 137/118.07 |
| 3,971,074 | A * | 7/1976 | Yxfeldt | A47K 3/287 | 4/570 |
| D370,250 | S * | 5/1996 | Fawcett | D23/213 | |
| 5,678,258 | A * | 10/1997 | Healy | A47K 3/28 | 4/601 |
| 6,233,757 | B1 * | 5/2001 | Graham | E03C 1/0408 | 4/570 |
| 6,415,461 | B1 * | 7/2002 | Singer | A47K 3/28 | 239/273 |
| 7,000,265 | B2 * | 2/2006 | Faisst | A47K 3/281 | 4/570 |
| 8,104,111 | B2 * | 1/2012 | Gross | E03C 1/0408 | 4/514 |
| 8,429,769 | B2 * | 4/2013 | Gross | E03C 1/06 | 4/601 |
| 9,242,259 | B2 * | 1/2016 | Jeronimus | B05B 7/0408 | |

(Continued)

*Primary Examiner* — Viet Le

(74) *Attorney, Agent, or Firm* — Jason T. Daniel, Esq.; Daniel Law Offices, P.A.

(57) ABSTRACT

A head and shoulder showerhead system includes a fluid diverter having a fluid inlet portion for engaging a shower arm of a water supply, a first fluid outlet portion, and a second fluid outlet portion. A first fluid dispenser is in fluid communication with the first outlet portion of the diverter and includes a circular shape with a plurality of dispensing nozzles. A second dispenser is in fluid communication with the second fluid outlet portion of the diverter via an elongated hose. The second dispenser includes a rectangular shape with a plurality of dispensing nozzles. An elongated rod is positioned beneath the first dispenser and the second dispenser is slidingly connected to the rod.

9 Claims, 4 Drawing Sheets

(56) References Cited

U.S. PATENT DOCUMENTS

| | | | | |
|---|---|---|---|---|
| 2005/0098661 | A1 | 5/2005 | Lev | |
| 2007/0158460 | A1 | 7/2007 | Lev | |
| 2008/0169362 | A1* | 7/2008 | Kwan | B05B 15/066 239/442 |
| 2012/0151669 | A1* | 6/2012 | Wilson | E03C 1/066 4/615 |
| 2015/0090811 | A1* | 4/2015 | Wu | B05B 1/169 239/446 |
| 2015/0090813 | A1* | 4/2015 | Zhang | F16K 31/1245 239/446 |

* cited by examiner

HEAD AND SHOULDER SHOWERHEAD SYSTEM

TECHNICAL FIELD

The present invention relates generally to showers, and more particularly to a head and shoulder showerhead system.

BACKGROUND

The statements in this section merely provide background information related to the present disclosure and may not constitute prior art.

Conventional wall mounted shower heads typically include a round or square shape that discharges water in a roughly circular pattern. This shape is typically insufficient to provide a continuous stream of shower water to both the head, back and shoulder area of a user. As such, users must often move from side to side to provide coverage onto their shoulders, or must purchase more expensive ceiling mounted shower heads that include a "rain" feature.

Accordingly, it would be beneficial to provide a showerhead that is designed to provide an even and uniform stream of shower water onto the entirety of a user's head and shoulders.

SUMMARY OF THE INVENTION

The present invention is directed to a showerhead system having a shape, size and functionality for allowing users to selectively wash an entirety of their shoulders and head. One embodiment of the present invention can include a fluid diverter having a fluid inlet portion for engaging a shower arm of a water supply, a first fluid outlet portion, and a second fluid outlet portion. A first fluid dispenser can be coupled to the diverter and can include a generally circular shape with a plurality of dispensing nozzles. A second dispenser can be coupled to the diverter and can include a generally rectangular shape with a plurality of dispensing nozzles.

Another embodiment of the present invention can include an elongated rod having a first end that is interposed between the first fluid dispenser and the first fluid outlet portion, and a bent second end for engaging the wall of a shower stall. The present invention can further include a connector that is disposed along the second fluid dispenser for slidingly engaging the elongated rod.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another component.

Figure 1:
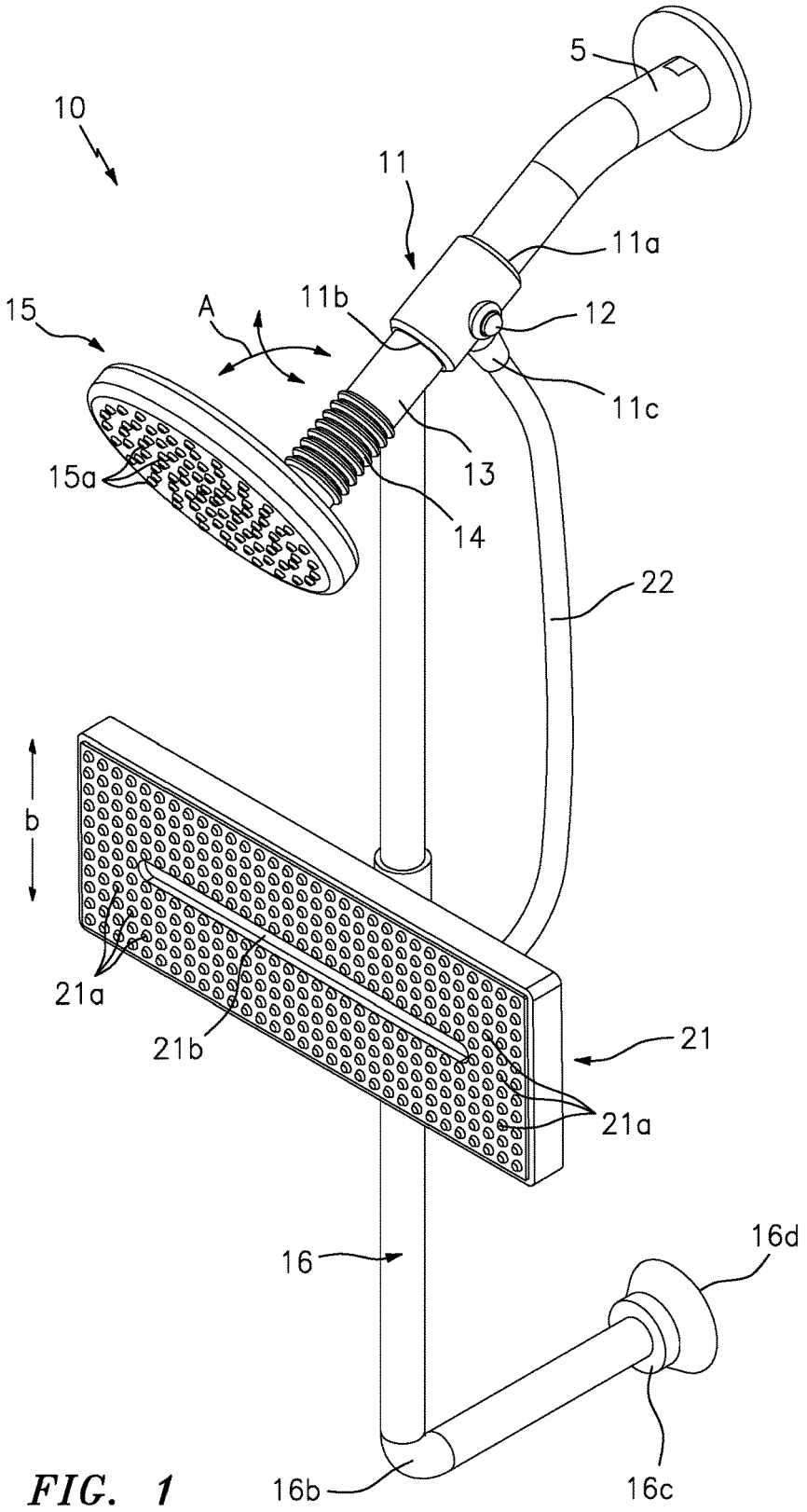
FIG. 1 is a perspective view of the showerhead system that is useful for understanding the inventive concepts disclosed herein.
Figure 2:
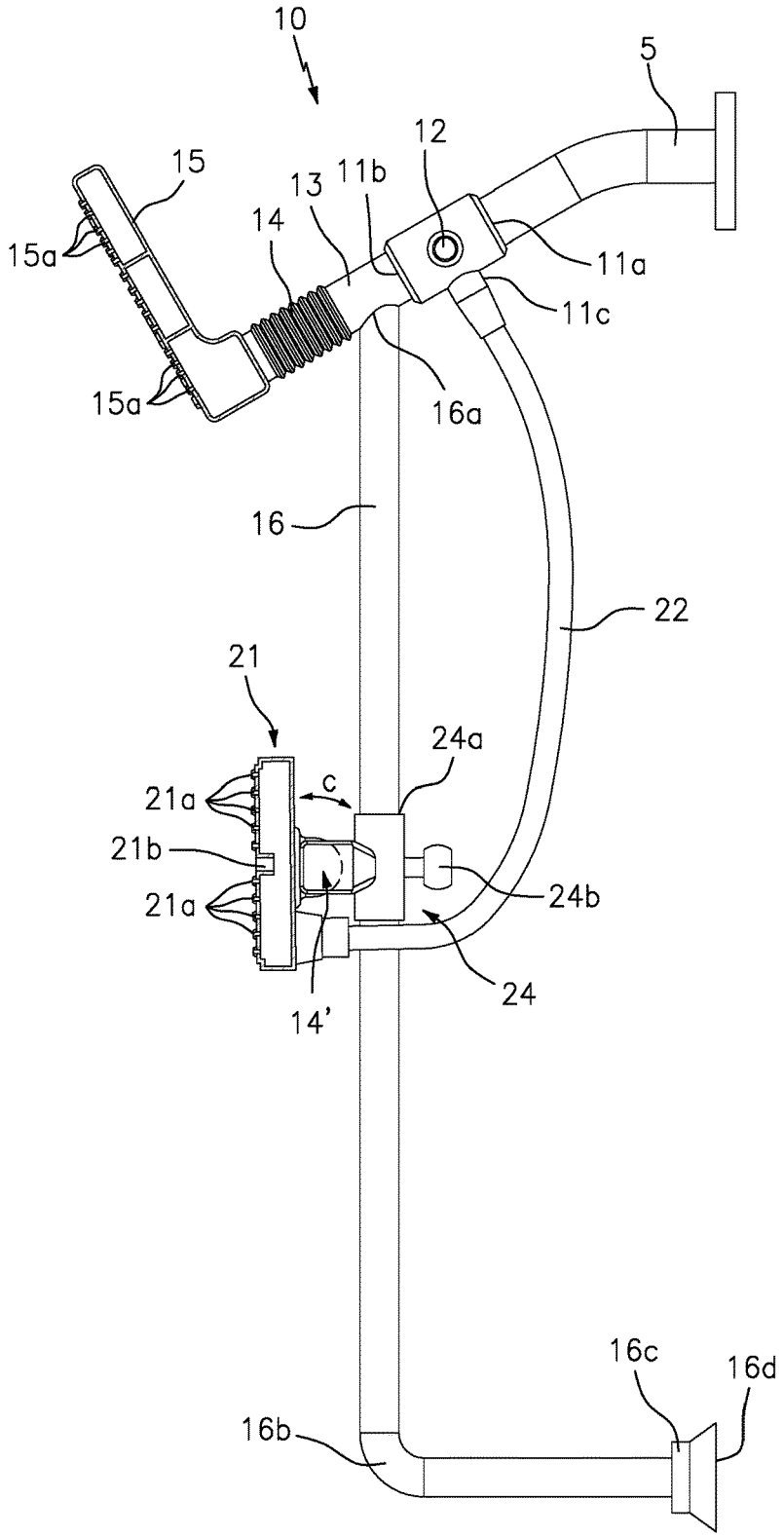
FIG. 2 is a side view of the showerhead system in accordance with one embodiment of the invention.
Figure 3:
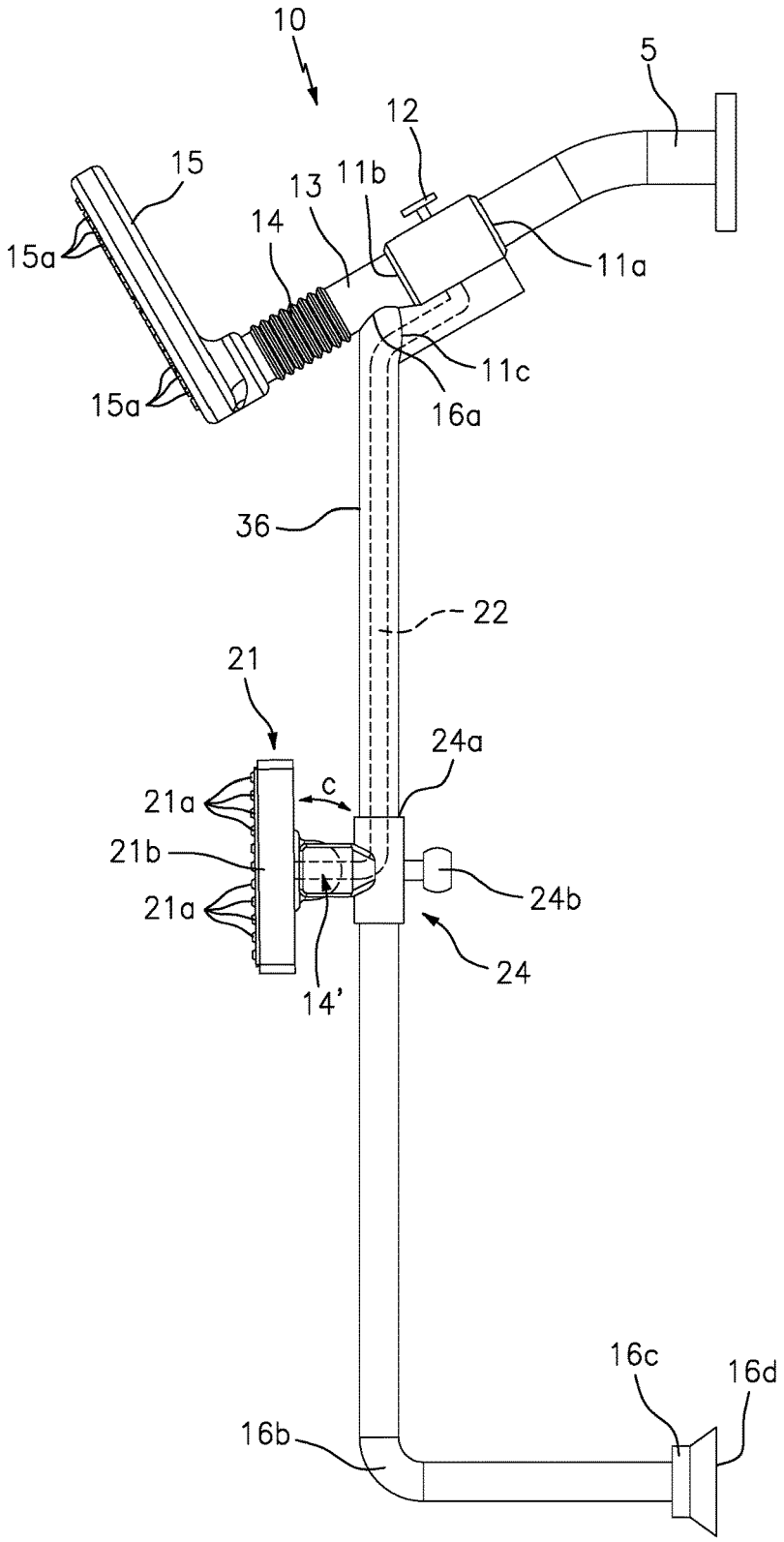
FIG. 3 is a side view of the showerhead system in accordance with another embodiment of the invention.

FIGS. 1-3 illustrate various embodiments of a head and shoulder showerhead system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIGS. 1 and 2 the system 10 can include, essentially, a fluid diverter 11, a first fluid dispenser 15, an elongated rod 16, and a second fluid dispenser 21. The system 10 can function to communicate with a wall mounted water supply 5 that is controlled by a water supply control valve (not illustrated), that are typically associated with a shower enclosure. The system can function to provide a user with the ability to stream a continuous flow of water onto an entirety of their head and/or shoulders through the use of the first and second fluid dispensers.

In one embodiment, the fluid diverter 11, can include a selector 12 such as a knob or button, for example that controls an internally located valve, "T" connector or other suitable directional flow control element. The diverter 11 can include a fluid input end 11*a* that is physically coupled to the output of the water supply 5 so as to receive water therefrom. Although not illustrated, this can be performed in the expected manner via a plurality of threaded elements along the input end of the diverter that can engage the complementary threaded elements on the shower arm of the water supply 5 via a twisting motion.

The fluid diverter can also include a first fluid output end 11*b* that is in communication with a rigid pathway 13 for selectively supplying water to the first fluid dispenser 15. The diverter can also include a second fluid output end 11*c* that is in communication with a hose 22 or other flexible pathway, for selectively supplying water to the second fluid dispenser 21. As will be further described, the fluid diverter 11 facilitates selective or combined fluid flow to either or both of the first and second fluid dispensers associated with the showerhead system 10.

The first fluid dispenser 15 can preferably include a generally circular shaped member that is in fluid communication with the output of the diverter. As shown, the dispenser 15 can include a plurality of fluid dispensing nozzles 15*a* formed along one or more faces of the dispenser 15. As described herein, each of the dispensing nozzles 15*a* can be disposed in either a contiguous or non-contiguous array pattern. Moreover, each of the nozzles may be formed in any desired pattern or arrangement, and can also be provided in different sizes and spray dispersion patterns within the skill of one in the ordinary art.

In the preferred embodiment, the first fluid dispenser 15 can be connected to the rigid pathway 13 by virtue of an articulating joint 14. The articulating joint 14 is appreciated to be any conventional adjustment mechanism known to the art, such as a ball joint type or other means of adjustment that affords the ability to tilt and/or rotate (see arrow a) the first dispenser 15 while allowing fluid to pass therethrough.

An elongated and rigid rod 16 can be connected to the pathway 13 along a first end 16*a*. The rod can include a bend 16*b* for positioning the second end of the rod 16*c* against the wall of the shower enclosure from which the water supply protrudes. In various embodiments, a support member 16*d* such as a suction cup, or mounting bracket, for example, can be secured along the second end of the rod 16*c*, to prevent movement of the rod during system operation.

The second fluid dispenser 21 can preferably include an elongated, generally rectangular-shaped member that is in fluid communication with the output of the diverter 11*c* via the hose 22. As shown, the second fluid dispenser 21 can include a plurality of fluid dispensing nozzles 21*a* formed along one or more faces of the dispenser 21. As described herein, each of the dispensing nozzles 21*a* can be disposed in either a contiguous or non-contiguous array pattern. Moreover, each of the nozzles may be formed in any desired pattern or arrangement, such as the elongated continuous stream "waterfall" feature 21*b*, for example, and can also be provided in different sizes and spray dispersion patterns within the skill of one in the ordinary art. Although not illustrated, optional embodiments of the second fluid dispenser 21 can include a curved face section containing the dispensing nozzles, so as to provide a wraparound shower flow pattern.

As shown, a sliding connector 24 can be disposed along one face of the second fluid dispenser 21, so as to secure the same onto the elongated rod 16. In various embodiments, the sliding connector can include a channel 24*a* having a shape that is complementary to the diameter of the rod 16 so as to receive the rod therein. A tensioning mechanism 24*b* such as a clasp, for example can function to engage the rod so as to selectively allow and prevent movement of the connector 24 along the length of the rod (see arrow b). Moreover, the sliding connector can also include an articulating joint 14' to allow the second dispenser 21 to tilt and/or rotate (see arrow c) during system operation.

In operation, the sliding connector can function to position the longitudinal axis of the second fluid dispenser at a generally perpendicular longitudinal axis to the overall system, as defined by the length of the elongated rod. Such a feature ensures that when the first fluid dispenser 15 is providing water onto the head of a user, the second fluid dispenser 21 is providing water onto both shoulders of the user.

Although illustrated with the hose 22 as a visible element, other embodiments are also contemplated. For example, FIG. 3 illustrates one embodiment that comprises a generally hollow elongated rod 36 into which the supply hose 22 is positioned. In such an embodiment, it is preferred that the hose be constructed with a plurality of bends/ripples, as are known in the art, so as to allow the length of the hose to stretch, based on the orientation of the second fluid dispenser along the rod 36.

Figure 4:
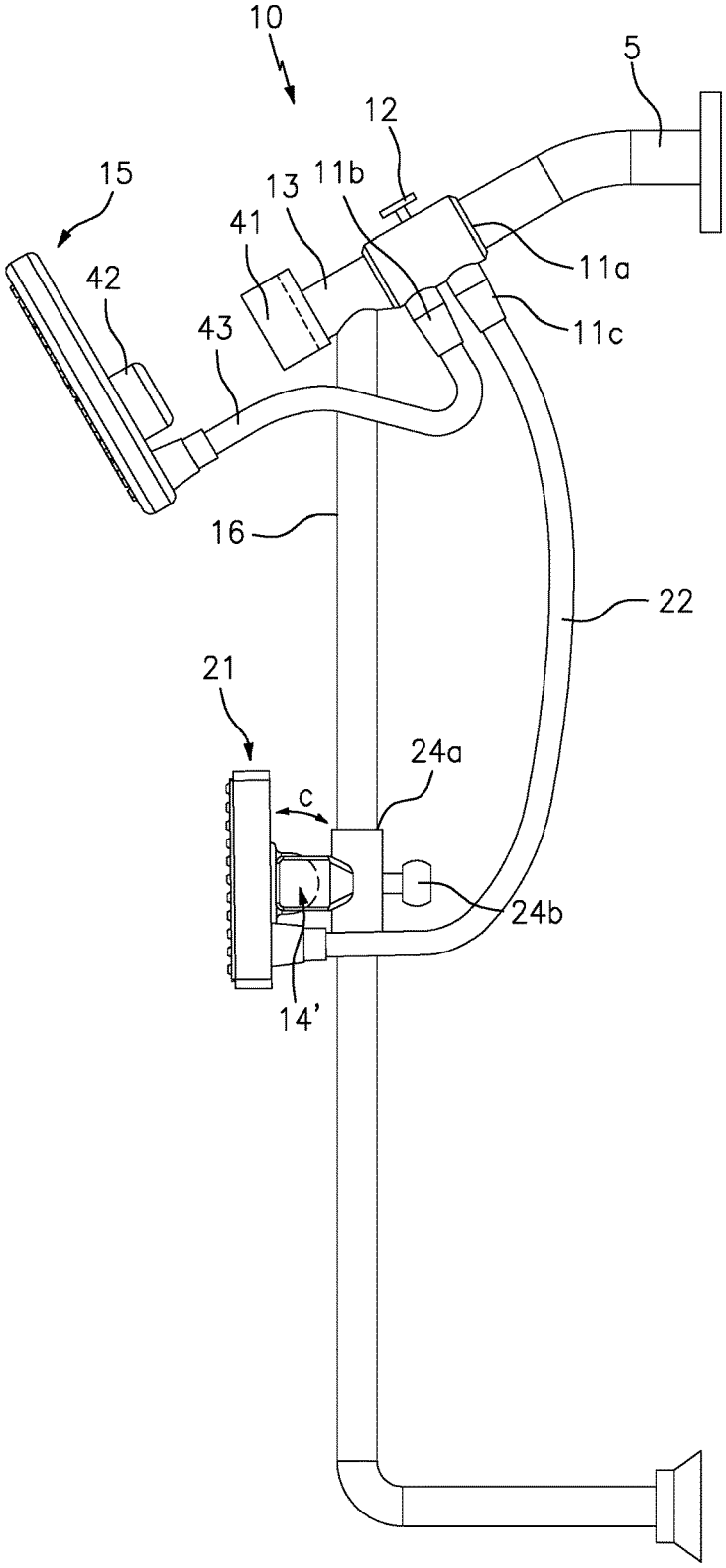
FIG. 4 is a side view of the showerhead system in accordance with another embodiment of the invention.

FIG. 4 illustrates another embodiment of the system 10, wherein the first fluid dispenser 15 is removably secured onto the rigid pathway 13. In the present embodiment, the above described articulating joint 14 is replaced with a clasp 41 for engaging a handle 42 along the back side of the dispenser 15. Likewise, a second hose 43 is in fluid communication with the diverter 11 for providing water to the dispenser 15.

Although dimensions are not critical, in the preferred embodiment, the first fluid dispenser 15 can preferably include an outside diameter of approximately 8-10 inches. As medical journals and associated textbooks list the average width of adult shoulders to be between 14 and 19 inches, it is preferred that the second fluid dispenser include a length along the longitudinal axis of between approximately 15 and 20 inches. Such dimensions being suitable for providing a continuous flow of shower water to cover an entirety of the users shoulders and body portions beneath.

As described herein, each component of the above described showerhead system 10 can be constructed from any number of different materials that are suitable for prolonged exposure to water such as various plastics, metals and/or composites, for example. Although not specifically illustrated, each of the first and second showerheads can include any number of different shapes, sizes and/or dimensions, such as a curved face, for example. Additionally, one or more elements of the showerhead system 10 can be secured together utilizing any number of known attachment means such as, for example, screws, glue, compression fittings and welds, among others. To this end, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A showerhead system, comprising:

a fluid diverter having a fluid inlet portion for engaging a shower arm of a water supply, a first fluid outlet portion, and a second fluid outlet portion;

a rigid pathway that is connected to the first fluid outlet portion;

a first fluid dispenser that is coupled to the rigid pathway and that is in fluid communication with the first fluid outlet portion, said first fluid dispenser including a circular shape and a plurality of fluid dispensing nozzles;

an elongated rod having a major axis that is perpendicular to the rigid pathway, said elongated rod including a first end that is connected to the rigid pathway, and a curved second end that is positioned parallel to the rigid pathway;

a support member that is disposed along the curved second end of the elongated rod, said support member being configured to secure the second end of the elongated rod to a wall to which the water supply is connected; and a second fluid dispenser that is slidingly engaged with the elongated rod, and is in fluid communication with the second fluid outlet portion, said second fluid dispenser including a rectangular shape and a plurality of fluid dispensing nozzles.

2. The system of claim 1, further comprising:

an articulating joint that is in physical and fluid communication with each of the first fluid dispenser and the rigid pathway.

3. The system of claim 1, further comprising:

a flexible hose that is interposed between the second fluid dispenser and the second fluid outlet portion.

4. The system of claim 3, wherein the elongated rod is hollow, and the flexible hose is positioned within the elongated rod.

5. The system of claim 1, further comprising:

a selector that is positioned along the fluid diverter and is configured to selectively discharge fluids from the inlet portion to each of the first and second outlet portions.

6. The system of claim 1, wherein the second fluid dispenser includes a width of between 15 and 20 inches, and a weight that is supported by the elongated rod.

7. The system of claim 6, wherein the second fluid dispenser comprises a plurality of fluid dispensing nozzles, and an elongated waterfall nozzle.

8. The system of claim 1, further comprising:

a second articulating joint that is in physical communication with the second fluid dispenser and the rigid pathway.

9. A showerhead system, consisting of:

a fluid diverter having a fluid inlet portion for engaging a shower arm of a water supply, a first fluid outlet portion, and a second fluid outlet portion;

a rigid pathway that is connected to the first fluid outlet portion;

a first fluid dispenser that is coupled to the rigid pathway and that is in fluid communication with the first fluid outlet portion, said first fluid dispenser including a circular shape and a plurality of fluid dispensing nozzles;

an elongated rod having a major axis that is perpendicular to the rigid pathway, said elongated rod including a first end that is connected to the rigid pathway, and a curved second end that is positioned parallel to the rigid pathway;

a support member that is disposed along the curved second end of the elongated rod, said support member being configured to secure the second end of the elongated rod to a wall to which the water supply is connected; and a second fluid dispenser that is slidingly engaged with the elongated rod, and is in fluid communication with the second fluid outlet portion, said second fluid dispenser including a rectangular shape having a width of between 15 and 20 inches, and a plurality of fluid dispensing nozzles.

* * * * *